United States Patent [19]

Cleary et al.

[11] Patent Number: 4,787,434

[45] Date of Patent: Nov. 29, 1988

[54] VACUUM LIFT FOAM FILLED CASTING SYSTEM

[75] Inventors: Terrance M. Cleary, Allenton; Raymond J. Donahue, Fond du Lac; William G. Hesterberg, Rosendale; Lawrence I. Toriello, Fond du Lac, all of Wis.

[73] Assignee: Brunswick Corporation, Skokie, Ill.

[21] Appl. No.: 946,812

[22] Filed: Dec. 29, 1986

[51] Int. Cl.[4] ..... B22C 9/04; B22D 18/06

[52] U.S. Cl. ..... 164/34; 164/119

[58] Field of Search ..... 164/34, 35, 235, 246, 164/119, 306

[56] References Cited

U.S. PATENT DOCUMENTS

| | | | |
|---|---|---|---|
| 3,861,447 | 3/1975 | Hondo . | |
| 3,863,706 | 7/1975 | Chandley . | |
| 3,900,064 | 11/1975 | Chandley . | |
| 4,112,997 | 4/1978 | Chandley . | |
| 4,340,108 | 7/1982 | Chandley . | |
| 4,589,466 | 5/1986 | Chandley et al. | 164/119 |
| 4,616,689 | 3/1986 | Denis . | |
| 4,693,292 | 9/1987 | Campbell | 164/34 |

FOREIGN PATENT DOCUMENTS 1166188 2/1984 Canada .

OTHER PUBLICATIONS

Robert K. Buhr, Panel: "The Evaporative Foam Casting Process—Looking to the Future and New Technologies", Evaporative Foam Casting Technology II Program, Nov. 12–13, 1986, pp. 179–184.

Ezra L. Kotzin, "Metalcasting & Molding Processes", Cast Metal Series, An American Foundrymen's Society Publication, Des Plains, Illinois 1981.

*Primary Examiner*—Kuang Y. Lin

*Attorney, Agent, or Firm*—Andrus, Sceales, Starke & Sawall

[57] ABSTRACT

A lost foam casting system (2) is provided with vacuum lift of molten metal (16) to an evaporative foam pattern assembly (8) surrounded by unbonded particulate media such as sand (6) in a flask (4). A gas permeable member (34, 70) or passage (72, 74) is provided between the sand and a vertical fill passage (20) to apply vacuum from the sand to the fill passage such that molten metal is vacuum lifted through the fill passage to the foam pattern assembly, such that the foam material vaporizes as the molten metal advances upward and is replaced by the metal in the shape of the pattern assembly.

3 Claims, 2 Drawing Sheets

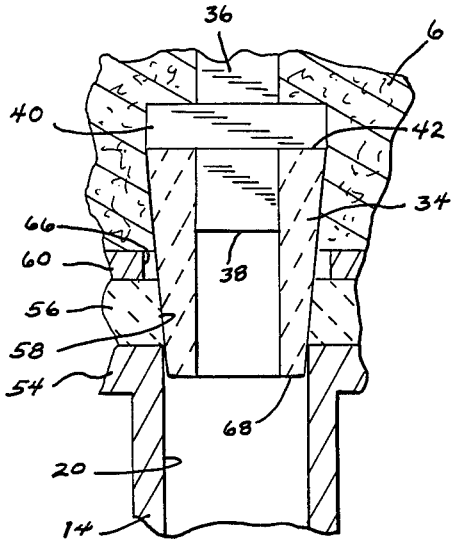
FIG. 2
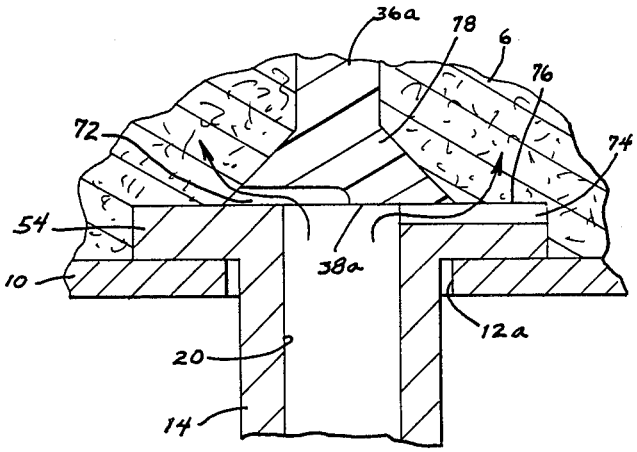
FIG. 3
FIG. 4
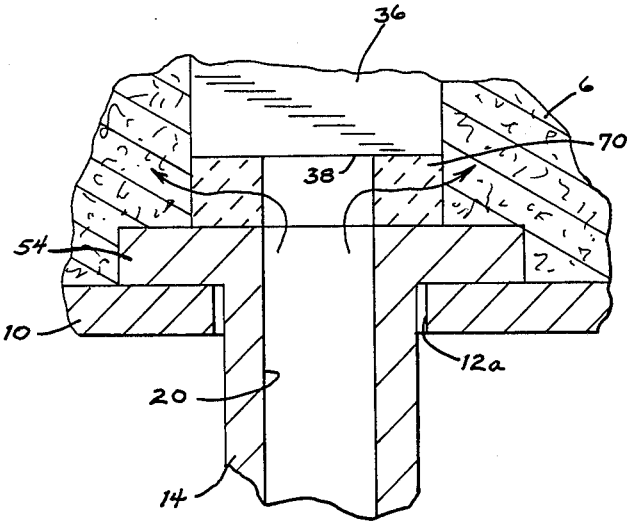

VACUUM LIFT FOAM FILLED CASTING SYSTEM

BACKGROUND AND SUMMARY

The invention relates to a lost foam casting system, and more particularly to an improved method and apparatus for introducing molten metal to the pattern assembly.

Lost foam casting is a known technique. A pattern assembly formed of evaporative foam material, for example gasifiable or liquifiable expanded polystyrene, or expanded polymethylmethacrylate (PMMA), either of which which may be coated with a thin ceramic coating, is placed in a flask and surrounded by unbonded particulate media, most commonly sand, though other particles can be used such as zirconia, metal spheres, etc. Upon application of molten metal to the pattern assembly, the foam material vaporizes and is replaced by the metal in the shape of the pattern assembly The vaporized foam material escapes into the interstices in the sand.

The pattern assembly typically includes one or more workpieces of given respective patterns for yielding cast metal parts, and a sprue connected by one or more in-gates to the workpieces for communicating the molten metal through the sprue to the in-gates and then to the workpieces. After cooling, the cast metal sprue and the in-gates are broken away from the workpieces and discarded or recycled. The cast metal workpieces are then trimmed to yield the final product.

The present invention arose out of efforts to provided improved cast aluminum alloy cylinder heads and engine blocks for internal combustion engines in marine applications, and cast steel two cyle outboard crankshafts, though the invention is not limited thereto.

In the present invention, molten metal is applied to the foam pattern assembly by vacuum lift. Vacuum is applied through the sand, and a gas-permeable member or path is provided communicating between the sand and a vertical fill passage such that molten metal is vacuum lifted to the foam pattern assembly.

BRIEF DESCRIPTION OF THE DRAWINGS

FIG. 2 is a sectional view of a portion of FIG. 1.

FIG. 3 is a view like FIG. 2 and shows an alternate embodiment.

FIG. 4 is a view like FIG. 2 and shows another alternate embodiment.

DETAILED DESCRIPTION

Figure 1:
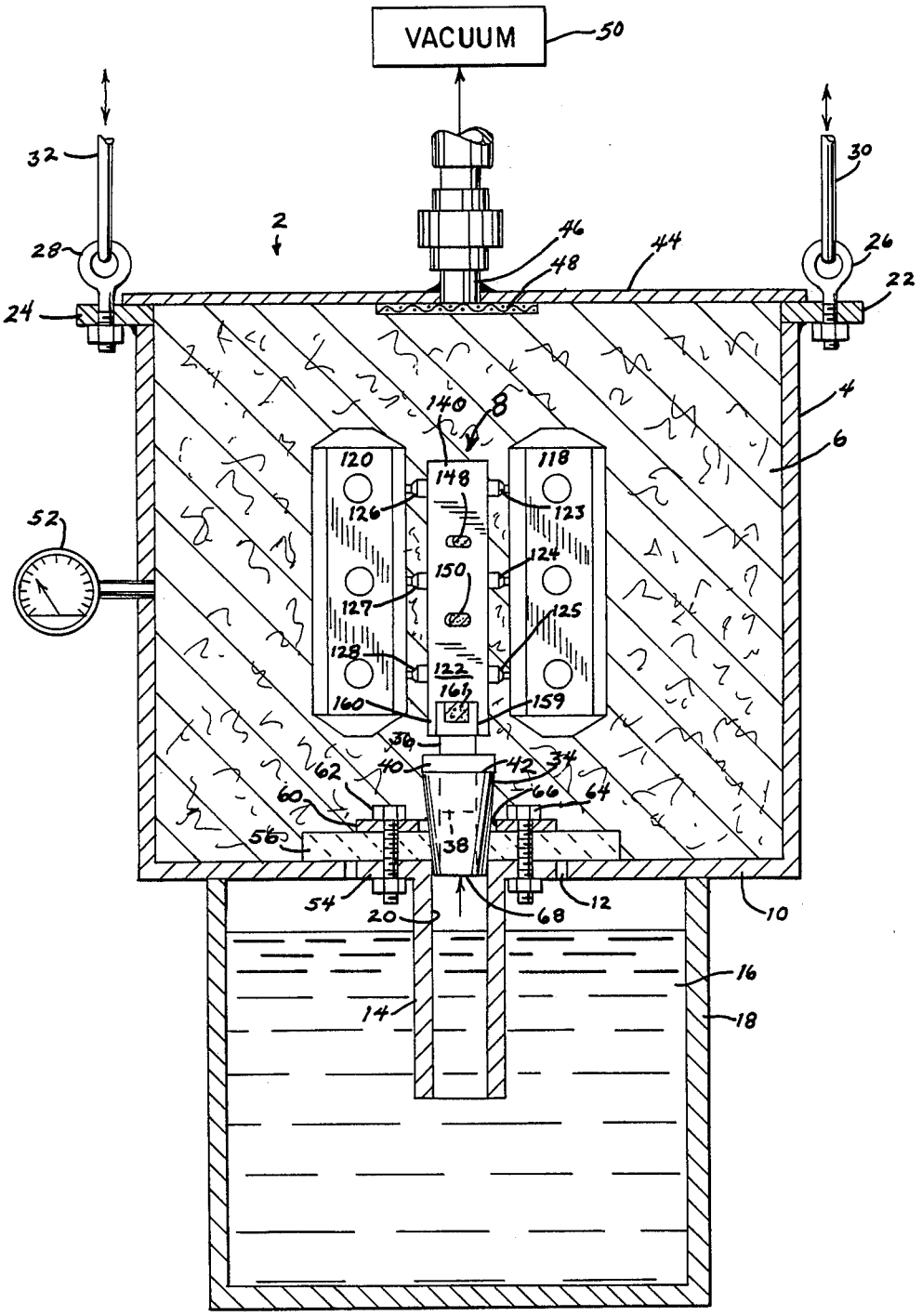
FIG. 1 is a side sectional view of a lost foam casting system in accordance with the invention.

FIG. 1 shows a lost foam casting system 2 in accordance with the invention. A flask 4, such as a cylindrical open topped barrel, is provided for holding unbonded particulate media 6, preferably sand, though other particles can be used, as noted above. Pattern assembly 8 is formed of evaporative foam material, for example gasifiable or liquifiable expanded polystyrene, or expanded polymethylemethacrylate (PMMA), either of which may be coated with a highly permeable thin ceramic coating. Pattern assembly 8 is gas-nonpermeable. Flask 4 has a bottom wall 10 with a central opening 12 therein through which a gas-nonpermeable fill tube 14 extends. A source of molten metal 16, such as provided by a furnace or reservoir 18 is disposed below flask 4. Fill tube 14 extends downwardly from the bottom of the flask and defines a vertical fill passage 20 communicating pattern assembly 8 with the source of molten metal. Flask 4 has peripheral flanges such as 22 and 24 for supporting the flask from eye hooks such as 26 and 28 and chains or cables such as 30 and 32 which in turn are supported from a hoist (not shown).

Flask 4 is initially in a raised position above molten metal source 18. Fill tube 14 is placed in the flask from above and inserted downwardly into and through opening 12 in the bottom of the flask and supported from bottom wall 10, to be described. An annular frusto conical gas-permeable throat 34 is then inserted partially into fill tube 14 from above. Pattern assembly 8 has a lower stem 36 with a bottom end 38 inserted partially into throat 34 until collar 40 on stem 36 is stopped against the top 42 of the throat. Sand is then poured into flask 4 surrounding throat 34 and pattern assembly 8. The sand is then compacted by vibration. The flask is then closed by top cover 44 which has a central fitting 46 therethrough beneath which is preferably a sand filter or screen 48. Flask 4 is then lowered such that the lower portion of downwardly depending fill tube 14 enters the molten metal 16 in source 18. A source of vacuum 50 is then connected to fitting 46 to apply vacuum to flask 4 and sand 6 therein, as monitored by vacuum gauge 52.

Gas-permeable throat 34 communicates between sand 6 and fill passage 20, which passage extends upwardly through throat 34 to pattern assembly 8. The vacuum is thus applied from sand 6 through gaspermeable throat 34 to fill passage 20 such that molten metal 16 from source 18 is vacuum lifted through fill passage 20. The foam material of pattern assembly 8 vaporizes and is replaced by the metal in the shape of pattern assembly 8. The vaporized foam material escapes into the interstices in sand 6. The heat radiation from the molten metal entry causes the foam to gasify, and the molten metal may or may not touch the foam prior to such gasification. Flask 4 is then raised in a timed manner such that when the casting inlet gates freeze the vacuum is released and the remaining molten metal in the gating system drains back into molten metal source 18. After sand dumping and cooling, the cast metal parts are broken away and trimmed, etc.

Fill tube 14 is a tubular member having an upper flange 54 engaging the underside of a refractory gas-nonpermeable annular disc 56. Flange 54 is in opening 12 and has a smaller diameter than opening 12. Disc 56 has an outer diameter larger than the diameter of opening 12 and engages the top side of bottom wall 10 of the flask. Disc 56 has a central opening 58 therethrough further defining vertical fill passage 20. A top annular ring 60 engages the top of disc 56, and bolts such as 62 and 64 extend through disc 56 bolting ring 60 and flange 54 to the disc. Ring 60 has a central opening 66 through which throat 34 extends downwardly. The inner diameter of throat 34 is substantially constant and of a width about the same as stem 36 and slightly smaller than the diameter of the depending tubular member of filler tube 14. The outer diameter of throat 34 frustoconically tapers downwardly and engages the inner diameter of disc 56. Throat 34 extends downwardly through opening 66 and through opening 58, and the bottom end 68 of throat 34 is at the level of flange 54, though other configurations are of course possible. Throat 34 spaces the pattern assembly above the filler tube. The gas-permeable path through throat 34 extends generally horizontally below the pattern assembly and above the fill tube, transversely through the generally vertical side walls of throat 34. The vacuum communication path through gas-permeable member 34 is generally transverse to the vertical lift path of the molten metal through fill passage 20.

FIG. 3 shows an alternate embodiment of the gas-permeable member and fill tube arrangement and uses like reference numerals from the above figures where appropriate to facilitate clarity. Throat 34 is replaced by a gas-permeable gasket 70 on flange 54 of fill tube 14. Stem 36 of pattern assembly 8 rests on gasket 70. Flange 54 rests on the top side of bottom wall 10 of the flask and the fill tube depends therefrom through central opening 12*a*. Gas-permeable gasket 70 communicates vacuum from sand 6 to fill passage 20, as in FIG. 1.

FIG. 4 shows another alternative gaspermeable means and fill tube arrangement and uses like reference numerals from the above figures where appropriate to facilitate clarity. The gas-permeable means is provided by one or more vacuum passages such as 72 and 74 formed through pattern assembly 8 and/or fill tube 14. FIG. 4 shows one such vacuum passage 72 formed by one or more exposed grooves along the underside of the pattern assembly, as along the bottom 38*a* of stem 36*a* of the foam pattern assembly. FIG. 4 also shows a passage 74 formed by one or more exposed grooves along the topside of the fill tube, as along the topside 76 of flange 54 of fill tube 14. In the embodiment of FIG. 4, the pattern assembly at its bottom edge 38*a* engages the fill tube at its top surface 76, and the vacuum passages 72 and 74 are at the interface 38*a*-76 of the pattern assembly and the fill tube. The vacuum passages extend generally radially outwardly and transversely from passage 20. Vacuum passages 72 and 74 communicate between sand 6 and fill passage 20 to apply vacuum from sand 6 through such vacuum passages 72 and 74 to passage 20 to lift the molten metal through such fill passage. In the embodiment in FIG. 4, the bottom stem 36*a* of the foam pattern assembly has a lower widened skirt portion 78 to engage the top of the fill tube, rather than nesting therein.

Pattern assembly 8 includes in this example one or more workpieces such as 118 and 120 of given respective patterns for yielding cast metal parts. The assembly further includes a central vertical sprue 122 connected by one or more in-gates such as 123–125 and 126–128 to respective workpieces for communicating molten metal through sprue 122 to the in-gates 123–128 and then to the workpieces 118 and 120. In the particularly disclosed embodiment, the sprue is a hollow square member open at the top and has six in-gates on a side, up to a total of twenty-four if all four sides are used. In principle the sprue could be much simpler, for example just a solid cylinder. The six in-gates pictured in the example shown in FIG. 1 are arranged in two vertical columns of three in-gates each, each of which sets of three in-gates is connected to a workpiece such as cylinder head, such as in-gates 123–125 connected to cylinder head 118. There are thus two cylinder heads per side of sprue 122, providing a total of up to eight cylinder heads. Each pair of cylinder heads on a side are interconnected by foam spacing members (not shown).

Sprue 122 is a one-piece molded member. In-gates 123–125 are formed with cylinder head 118 and then glued to the flat side of the sprue. Alternatively, the in-gates may be molded with the sprue and then glued to the respective cylinder heads, or further alternatively the in-gates may be formed as separate members and glued to the sprue and glued to the respective cylinder head. During vaporization of the foam material of the pattern assembly, the glue also melts and is vaporized and escapes into the interstices in the sand. It is desirable to reduce the number of glue joints to reduce the amount of glue which must be vaporized because excessive amounts of same will cause carbon related imperfections in the final cast metal part.

Sprue 122 has four vertical feed passages interconnected by the four support walls forming the square and providing a relatively rigid structure. The feed passages are at the corners and pass substantially more molten metal than the support walls therebetween. The in-gates are fed with molten metal from respective feed passages. The support walls are thin flat members connected edge to edge to define a square exterior perimeter surrounding a hollow interior. The exterior perimeter has the noted four corners at the respective intersections of the flat walls. The feed passages are at the respective corners and have a substantially larger cross sectional thickness than the flat support walls therebetween and bulge inwardly from the corners such that the exterior of the sprue is flat from corner to corner to facilitate workpiece and in-gate placement. The placement of the in-gates is relatively noncritical because of the flat exterior surface of the sprue. Furthermore, the relatively rigid structure of the sprue prevents distortion during the fluidization cycle and hence maintains close mechanical tolerances, which is extremely important for cylinder heads.

One or more of the vertical thin flat support walls such as front wall 140 has a pair of apertures 148 and 150 for passing sand therethrough to fill the hollow interior of the sprue, in addition to sand filling the hollow interior of the sprue through its open top, to provide high surface area sand contact to volume ratio to maximize escape of vapor and to promote rapid cooling.

Sprue 122 which, as noted above, could be as simple as a sold expanded PMMA cylinder, has the noted lower stem portion 36 for receiving molten metal through fill passage 20 from source 18, and has a distribution portion provided by a plurality of fingers or spokes such as 159 and 160 extending radially outwardly from stem 36 and then vertically upwardly to the noted feed passages at the corners of the sprue. The sprue is open, as shown as 161, between such spokes or fingers. Stem 36 may be a solid foam member, but preferably is at least partially hollowed out to reduce bulk density and buoyancy during the liquification process and to reduce wasted metal.

It is recognized that various equivalents, alternatives and modifications are possible within the scope of the appended claims.

We claim:

1. A lost foam casting method comprising:

providing a flask for holding particulate media;

providing a source of molten metal external of said flask;

providing gas-nonopermeable fill means having a fill passage communicating between said source of molten metal and the interior of said flask;

providing gas-permeable throat means communicating between said fill passage and the interior of said flask;

providing a gas-nonpermeable pattern assembly of evaporative foam material and placing said pattern assembly in said flask in communication with said fill passage;

introducing particulate media into said flask to surround said pattern assembly and said throat means such that said fill passage communicates said pattern assembly with said source of molten metal, and said throat means communicates between said particulate media and said fill passage;

applying vacuum to said flask and said particulate media, such that vacuum is applied from said particulate media through said throat means to said fill passage such that molten metal is drawn solely by vacuum through said fill passage from said source of molten metal, and such that said foam material vaporizes and is replaced by said metal in the shape of said pattern assembly, said vaporized foam material escaping into the interstices in said particulate media.

2. The invention according to claim 1 comprising providing said fill means with a fill tube extending downwardly from the bottom of said flask and defining a generally vertical lift path through said fill passage, and providing said gas-permeable throat means between said pattern assembly and said fill tube to define a gas-permeable path between said pattern assembly and said fill tube through which path vacuum is applied from said particulate media to said fill passage along said lift path.

3. The invention according to claim 2 comprising applying said vacuum through said gas-permeable path generally transversely of said lift path.

* * * * *

UNITED STATES PATENT AND TRADEMARK OFFICE

CERTIFICATE OF CORRECTION

PATENT NO. : 4,787,434

DATED : November 29, 1988

INVENTOR(S) : TERRANCE M. CLEARY ET AL

It is certified that error appears in the above-identified patent and that said Letters Patent is hereby corrected as shown below:

Col. 4, line 59, claim 1, delete "gas-nonopermeable" and substitute therefor -- gas-nonpermeable --; Col. 6, line 11, claim 2, after "passage" insert -- to lift said molten metal through said fill passage --.

Signed and Sealed this

Twenty-sixth Day of December, 1989

*Attest:*

JEFFREY M. SAMUELS

*Attesting Officer* *Acting Commissioner of Patents and Trademarks*